United States Patent [19]

Knudson

[11] 4,120,123

[45] Oct. 17, 1978

[54] STRUCTURAL CAP AND COMPOSITE STRUCTURE FOR BUILDINGS AND THE LIKE

[76] Inventor: Gary A. Knudson, 17356 W. 57th Ave., Golden, Colo. 80401

[21] Appl. No.: 741,512

[22] Filed: Nov. 15, 1976

[51] Int. Cl.[2] ..... E04B 1/32; E04B 1/88; E04C 1/30

[52] U.S. Cl. ..... 52/86; 52/406; 52/528; 52/588

[58] Field of Search ..... 52/588, 406, 528, 404, 52/579, 86, 618, 88, 332, 714, 335

[56] References Cited

U.S. PATENT DOCUMENTS

| | | | |
|---|---|---|---|
| 892,248 | 6/1908 | Garvin | 52/259 X |
| 2,045,117 | 6/1936 | Brown | 52/94 |
| 2,730,210 | 1/1956 | McLaughlin et al. | 52/619 |
| 2,913,104 | 11/1959 | Parker | 52/406 X |
| 3,127,962 | 4/1964 | James | 52/588 |
| 3,131,794 | 5/1964 | Bender | 52/588 |
| 3,267,626 | 8/1966 | Daly | 52/619 X |
| 3,276,171 | 10/1966 | Brown | 52/86 |
| 3,304,680 | 2/1967 | Bordwell | 52/335 X |
| 3,320,708 | 5/1967 | Bard | 52/404 X |
| 3,333,383 | 8/1967 | Randebaugh, Jr. | 52/588 X |
| 3,514,915 | 6/1970 | Johnson | 52/404 X |
| 3,524,292 | 8/1970 | Bottom | 52/588 X |
| 3,555,758 | 1/1971 | Schroter | 52/528 X |
| 3,557,502 | 1/1971 | Krebs | 52/588 X |
| 3,595,726 | 7/1971 | Middleton | 52/588 X |
| 3,606,718 | 9/1971 | Curran | 52/588 X |
| 3,608,267 | 9/1971 | Curran | 52/588 X |
| 3,729,879 | 5/1973 | Franklin | 52/406 X |
| 3,733,767 | 5/1973 | Craik | 52/588 X |
| 3,842,550 | 10/1974 | Duquette | 52/86 X |
| 3,898,783 | 8/1975 | Matlock et al. | 52/529 |
| 3,902,288 | 9/1975 | Knudson | 52/630 X |
| 3,998,019 | 12/1976 | Reinwell, Jr. | 52/588 X |

FOREIGN PATENT DOCUMENTS

| | | | |
|---|---|---|---|
| 257,361 | 9/1961 | Australia | 52/588 |
| 284,855 | 10/1966 | Australia | 52/588 |
| 625,159 | 8/1961 | Canada | 52/86 |
| 2,205,479 | 8/1973 | Fed. Rep. of Germany | 52/542 |
| 2,305,620 | 8/1973 | Fed. Rep. of Germany | 52/86 |
| 2,457,742 | 6/1976 | Fed. Rep. of Germany | 52/588 |
| 592,326 | 7/1925 | France | 52/528 |
| 1,321,562 | 2/1963 | France | 52/588 |

*Primary Examiner*—Leslie Braun
*Attorney, Agent, or Firm*—Ancel W. Lewis, Jr.

[57] ABSTRACT

A structural cap fastens along its opposite side edges to the seam structure joining a generally channel-shaped structural panel to adjacent similar panels to form a four-sided, closed, generally tubular, composite structure that has considerably greater load-bearing strength than the connected panel alone. Where temperature differentials between the inside and outside are a factor a body of heat insulation is provided in the closed space as well as heat insulation between the fastening side edges of the cap and the connecting seam structures. Each structural cap is preferably made as a one-piece body of sheet metal that is shaped to have an intermediate cover portion that overlays the bottom of the panel and side edge portions on opposite sides of the cover portion including sidewall sections that recess the cover portion inwardly of the outside of the panel and reinforce the sidewalls of the panel and a generally channel-shaped section that cups over to cover the seam structure joining two of the panels side by side as well as the side edge portion of the next adjacent cap. A terminal fastening section of the cap is folded back under and against the inner face of the next adjacent similar cap to form a longitudinally continuous connecting seam for the cap.

5 Claims, 9 Drawing Figures

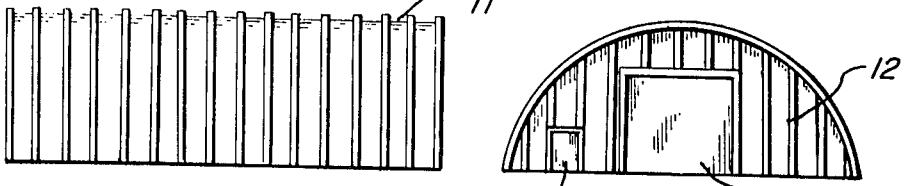
Fig_1
Fig_2
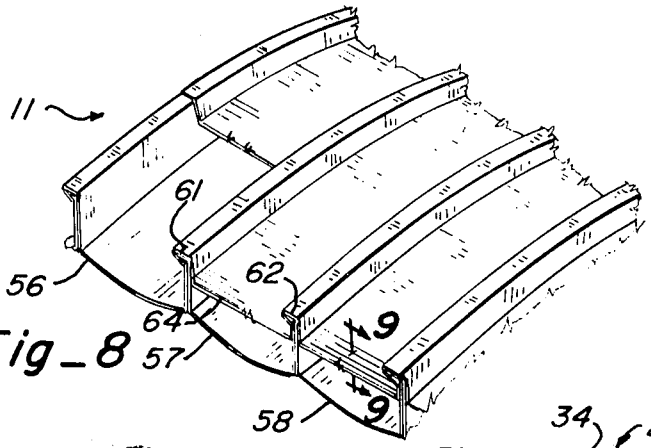
Fig_8
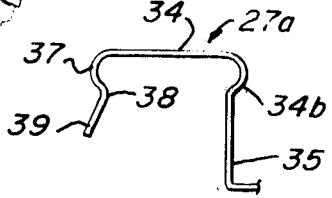
Fig_5
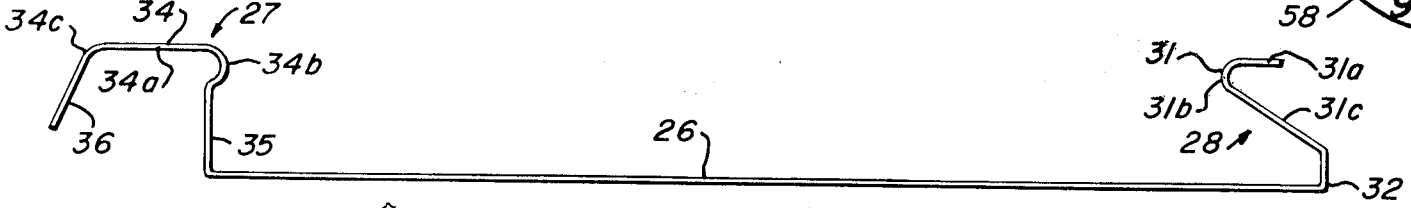
Fig_4
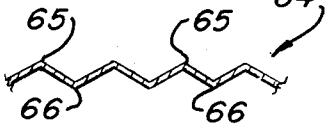
Fig_9
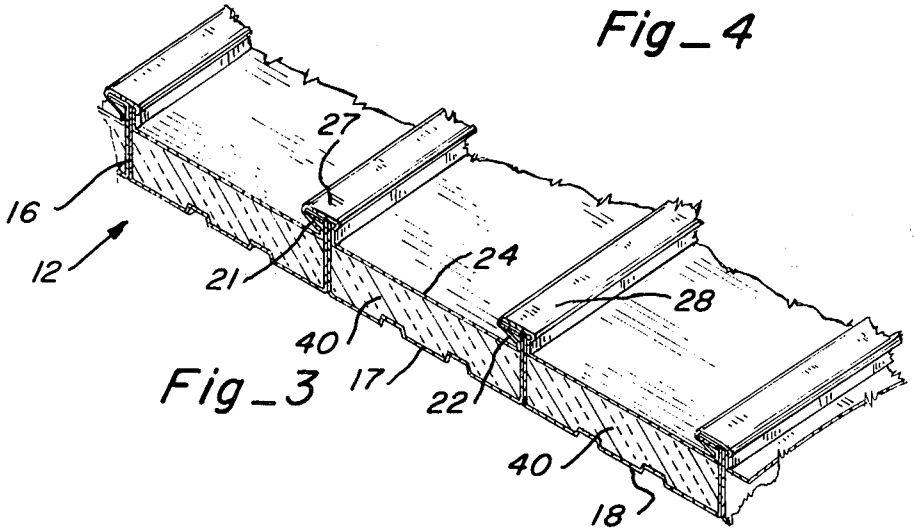
Fig_3

STRUCTURAL CAP AND COMPOSITE STRUCTURE FOR BUILDINGS AND THE LIKE

FIELD OF THE INVENTION

This invention generally relates to shaped structural members and more particularly to novel and improved shaped structural members for buildings and the like of the type that are readily shaped from flat sheet metal.

BACKGROUND OF THE INVENTION

There are a wide variety of structural members or structural panels presently being made of a relatively light-gauge sheet metal. This material has comparatively high strength for its thickness and can be shaped into a variety of cross sections using various techniques such as stamping devices, presses, continuous cold roll-forming apparatus and the like. Shaped structural members have been found to be particularly useful in the construction of utility buildings and like structures. Shaped sheet metal structural members heretofore provided have frequently taken the form of a channel or trough having a bottom and opposed sidewalls and an outer opening. Such a channel-shaped structure made of sheet metal is readily cold roll-formed and is readily connected side by side by using side flanges.

The use of shaped sheet metal structures or panels has been greatly enhanced by recent developments and improved practices in utilizing relatively lightweight, portable, roll-forming apparatus that is taken to the job site and is used to form continuous, one-piece, generally channel-shaped structural panels. In constructing a building or like structure these panels are first rolled into the required shape and cut to the required length, assembled side by side, and then are connected together along a continuous seam using a highly efficient seam-forming device. The individual panels formed by the abovedescribed apparatus may be generally characterized by having a generally channel-shaped configuration with a connecting flange at the outer free end of one side wall turned laterally into the channel opening and another connecting flange at the outer free end of the other sidewall that turns laterally away from the channel opening, and these flanges are used to connect the panels side by side at a continuous seam without the use of bolts or third element connectors.

The forming apparatus has a curving section that curves a straight formed panel into a shape that is substantially semicircular along its length and this curved or arched free-span panel forms both the top and sides of the building without additional support. The straight-shaped panels are used to close the ends of the building. The details of the panel and assembly practices are described more fully in my U.S. Pat. Nos. 3,875,642, 3,842,627, 3,902,288 and 3,967,430.

Among the advantages of this approach to forming structural panels and constructing buildings and like structures are that the panels may be continuously formed and cut to the precise length required at the job site, the greater efficiency in shipping relatively compact coil stock to the job site and storing same at the job site until used, and the fact that these continuous one-piece panels provide relatively wide, free-span structures that do not require additional structural support.

In the construction of buildings using the abovedescribed free-span, arched panels there are, however, special circumstances and certain applications in which additional strength may be required and applications in which heat insulation is desirable or required.

Accordingly, it is an object of the present invention to provide a novel cap for covering a generally channel-shaped panel or shaped structure which interconnects therewith in such a way as to greatly increase the structural strength of the composite structure over that of the panel alone.

Another object of the present invention is to provide a novel cap for a generally channel-shaped panel that provides a composite structure closed on all sides that is capable of being effectively heat-insulated.

Another object of the present invention is to provide a novel composite structure comprised of a generally channel-shaped panel and a cap covering and secured to the panel, the composite structure being heat-insulated so as to eliminate all metal-to-metal contact between the cap and panel.

Still a further object of the present invention is to provide a novel cap for shaped panels such as building panels characterized by a longitudinal, continuous, one-piece body having opposed side edge portions that are readily formed as a unitary construction from sheet metal in a continuous, cold roll-forming operation and are readily fastened securely to assembled shaped panels so as to remain in place and form a composite structure that is considerably stronger than the connected shaped panels alone.

Yet another object of the present invention is to provide a novel structural cap for a generally channel-shaped structural panel having oppositely disposed edge portions that cover and strengthen oppositely disposed connecting side flanges of the panel and are supported in place by a generally channel-shaped intermediate body portion that inserts into and resists deformation of the sidewalls of the structural panel under loads.

SUMMARY OF THE INVENTION

A structural cap has a side edge portion that covers and fastens to the seam structure joining a generally channel-shaped panel side by side so as to increase the load-bearing character of the resulting composite structure as compared to the panel alone. Each cap has a longitudinally continuous, one-piece, sheet metal body shaped to include an intermediate cover portion and oppositely disposed first and second side edge portions, each with a lateral section constructed for being superposed on a first and a second seam structure, respectively, joining a panel with two adjacent similar panels. The lateral sections seat on associated seam structures and locate said cover portion in a selected spaced covering relation extending transverse to the bottom of the joined inner panel thereby forming a closed space and further strengthening the associated seam structures.

The first side edge portion has a section for fastening it to one of the seam structures upon which there has been positioned a lateral section of the side edge portion of a next adjacent similar cap. Each side edge portion shown also includes a sidewall section connected between the cover portion and an associated lateral section that positions the cover portion in an inset location within the building panel, holds the cover portion against lateral movement, and further serves to cover the sidewall of the associated inner panel and to strengthen the sidewall of the inner panel. The second side edge portion is fastened to the second seam structure by the fastening section of the next adjacent similar cap in a seam assembly of the cap and connected inner panels. Heat insulation is provided in the closed space and between metal-to-metal surfaces of the cap and panel, if required.

Other objects, advantages and capabilities of the present invention will become more apparent as the description proceeds taken in conjunction with the accompanying drawings, in which like parts have similar reference numerals and in which:

FIG. 1 is a side elevation view of a building having shaped structures embodying the present invention;

FIG. 2 is an end elevation view of the building of FIG. 1;

FIG. 3 is a perspective view of a portion of an end wall composite structure of the building of FIGS. 1 and 2 shown with heat insulation;

FIG. 4 is an end view of a cap of the present invention prior to being fastened to the panels;

FIG. 5 is an end view of a modified form of side edge-fastening portion using a snap-action fastener for the cap shown in FIG. 4;

FIG. 8 is a perspective view of a portion of the composite structure forming the top and sidewalls of the building without heat insulation; and FIG. 9 is a sectional view taken along lines 9—9 of FIG. 8.

DESCRIPTION OF THE PREFERRED EMBODIMENTS

Figure 7:
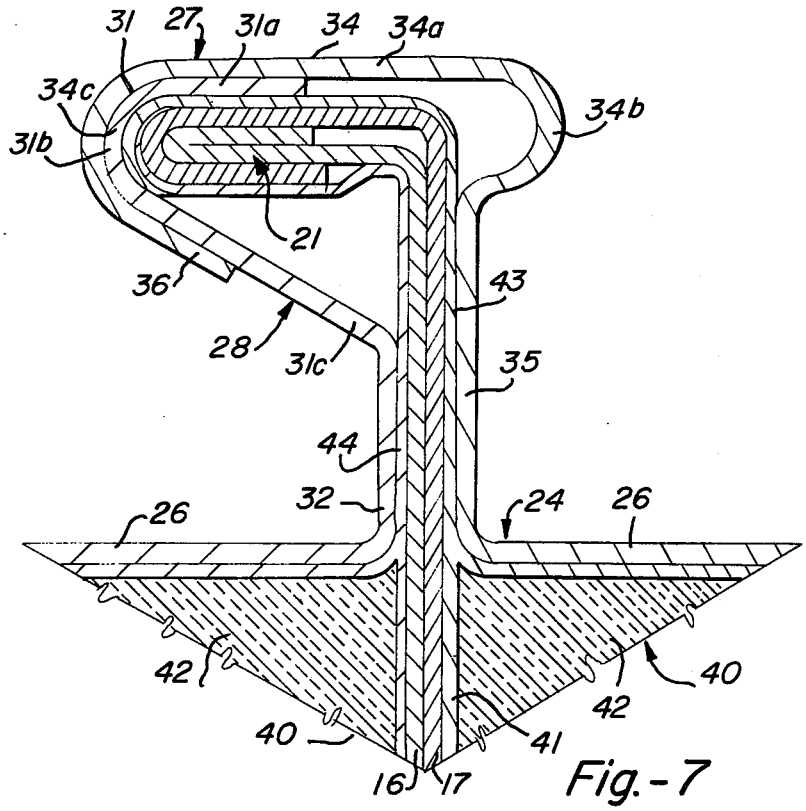
FIG. 7 is an enlarged sectional view of one of the seams with the structural cap and insulation connected to the structural panel.

In describing the specific embodiments herein chosen for illustrating the present invention, the terms "inner" and "outer" refer to directions as they relate to what is commonly referred to as the inside or outside of the composite structure with relation to the out of doors or atmosphere and weather elements. The outer side or face is that exposed to the atmospheric elements and the inner side or face is that which is protected by the structure from the outside or atmospheric elements. This terminology is used for convenience and reference purposes only and is not intended to have a limiting significance.

Referring now to the drawings, there is shown in FIGS. 1 and 2 a building having a longitudinally curved or arched composite structure 11 that is substantially semicircular in extent and forms both the top and sides of the building and end wall composite structures 12 connected to the ends of structure 11 that close the ends of the building. The building shown in FIGS. 1 and 2 has suitable doors 13 and 14 in the end wall composite structure 12.

The end wall composite structure 12 shown in FIG. 3 comprises a plurality of similar shaped, structural panels 16, 17 and 18 connected side by side at two longitudinally continuous seam structures 21 and 22 extending along opposite side edges of the connected shaped, structural panel 17. The seam structures 21 and 22 are identical and each is formed by flange portions that are preferably made as an integral part of a one-piece, sheet metal body and extend generally laterally from the outer edges of the sidewalls and interlock as described in earlier U.S. Pat. Nos. 3,902,288 and 3,967,340 using seamforming apparatus described in 3,875,642.

Each connected panel shown in FIG. 3 is covered by a shaped, structural cap designated 24 for panel 17 and the cap 24 will now be described in detail with reference to FIG. 4, since a description of one cap applies to all of the caps. The cap 24 comprises an elongated, longitudinally continuous, longitudinally straight, one-piece, sheet metal body which includes a flat cover portion 26 shaped and sized to traverse the outer side or face of the bottom of the structural panel 17 when positioned between the sidewalls so as to form a closed inside space. This body further includes side edge portions generally designated by numerals 27 and 28 that extend along opposite marginal edges of the cover portion 26 and cooperatively associate with the connecting seam structures 21 and 22, respectively, and the inside of the sidewalls of the connected building panel 17, as described more fully hereinafter.

The side edge portion 27 shown in FIG. 4 (herein referred to as the first side edge portion) may be generally referred to or characterized as a substantially channel-shaped section sized to cup over the outer faces of the seam structure and having the free end of one inverted leg of the channel-shaped section connected to one marginal side edge of the cover portion 26. The opening or mouth of this channel-shaped section is wider than the width of the seam structure that it covers so that it freely inserts over the seam structure and nests or cups over the outer faces of the seam structure in a covering relation.

More specifically, the side edge portion 27 includes an intermediate, substantially channel-shaped section 34, a sidewall section 35 and a terminal fastening section 36. The intermediate, substantially channel-shaped section 34 is further designated as having a flat lateral section **34*a* that seats on the outer face of the side edge portion of the next adjacent similar cap and is superposed on the associated panel seam structure, an arcuate section 34*b* that connects between lateral section 34*a* and the outer edge of the sidewall section 35 providing a track for the seam-forming apparatus that folds section 36 to the closed, fastening position, and a curved section 34*c* opposite section 34*b* that connects between section 34*a* and fastening section 36. The seam-forming apparatus may take the form of that shown in U.S. Pat. No. 3,875,642 with sets of rollers shaped to track against portion 34*b* and a set of rollers to urge the fastening section from the open to the closed position as the seam-forming apparatus continuously moves along the seam shown in more detail in FIG. 7**.

The side edge portion 28 shown in FIG. 4 (herein referred to as the second side edge portion) may be generally characterized as having a generally C-shaped section 31 and a sidewall section 32. The generally C-shaped section has a mouth or opening disposed along the side edge which is sized to slide freely over the seam structure connecting the building panels and cups or nests over the lateral projection of that seam structure when the cap is first positioned in place on the connected panel.

More specifically, this generally C-shaped section 31 has a flat lateral section **31*a* that seats on the outer face of the seam structure connecting the panels, a curved section 31*b* that extends around the free corner of the seam structure, and an inclined section 31*c* that connects between curved section 31*b* and the outer edge of sidewall section 32. Sidewall sections 32 and 35 then connect to the opposite marginal edges of the cover portion 26, extend normal thereto and are parallel to one another. The size and spacing of the sidewall sections 32 and 35 are such that they with the cover portion 26 form a channel-shaped body that nests snugly within the panel to cover the bottom and sidewalls thereof and the cover portion 26 serves as a stiffener to position and hold the sidewall sections 32 and 35 against the sidewalls of the panel to strengthen or reinforce the panel. The fit or spacing between the sidewall sections 32 and 35** of the cap and the sidewalls of the panel may depend to some extent on the thickness of the insulation provided therebetween, as described more fully hereinafter, but in any event there is a snug fit for strength purposes.

A modified form of side edge portion 27*a* shown in FIG. 5 has a curved section 37 that turns back into a fastening edge 38 and terminates in a fastening section 39. In this form the side edge portion 27*a* is substantially a channel-shaped section and includes a substantially flat lateral section that seats on the outer face of the seam structure and has a pair of oppositely disposed, generally arcuate or curved side sections 34*b* and 37 of a similar size and shape that cover side portions of the seam structure connecting panels side by side. The curved side section 37 turns back in toward the cover portion and connects with the fastening section 39 at a fastening edge 38 to form an opening across the channel-shaped section which is narrower than the width of the associated seam structure. In this way the side edge portion 27*b* snap-fits over the associated seam structure as a snap-action fastener due to the resiliency in the sheet metal. The fastening section 39 then preferably is folded to a closed position shown in FIG. 7 to further fasten the cap to the associated seam structure, using a suitable seam-forming structure as above described.

Figure 6:
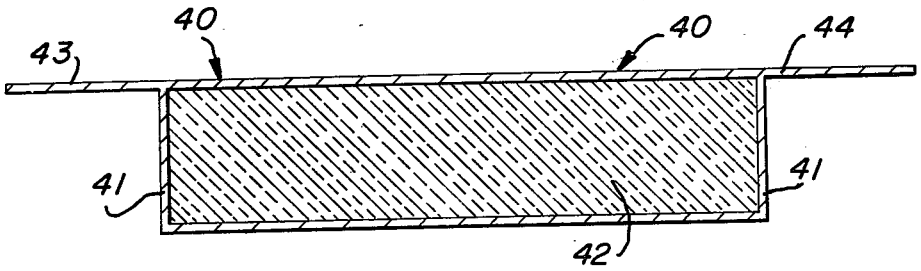
FIG. 6 is an enlarged transverse cross-sectional view of an insulation block prior to assembly.

The assembly shown in FIG. 6 is illustrated as being provided with heat insulation although it is understood that this additional construction is optional since this is required only where heat transfer is an important consideration. The heat insulation block 40 shown in more detail in FIG. 6 has an oblong, tubular casing 41, preferably of paper or like heat-insulating material, and the casing 41 contains an insulation material 42 such as fiberglass fill. The block 40 is sized to insert into the cavity of the panel and fill the cavity and to some extent is deeper than the depth of the closed space formed by the cap and panel so that the cap compresses the block. The insulation block shown has tab extensions 43 and 44 of a heat-insulation material such as paper on each side adjacent the top and preferably is provided with an adhesive on each face thereof to facilitate their fastening to the seam structure. An alternative to providing the tabs on the block as shown is to tape the connecting seam structure, as to the tabs shown, with a heat-insulation material to prevent metal-to-metal contact and this would eliminate the tabs from the block. The tabs, however, do serve to hold the insulation block in place on the panel while the cap is being secured.

Referring now to FIG. 7, in the assembly of the insulation blocks 40 they are first placed in through the open channels of two of the connected panels. The adjacent adhesively coated tabs 43 and 44 are folded around the seam structure designated 21 connecting the two panels. Specifically, beginning at the left panel 16 the tab 44 is secured to the panel sidewall and folded under and around the seam structure 21. The tab 43 of the block positioned in the next panel is then folded along the inside of the panel sidewall, over the outer face, and wrapped along the free edge overlapping the end of tab 43. The side edge portion 28 of the cap for the left panel 16 is first put in place covering the overlapping portions of tabs 43 and 44 and a portion of the outer face of the seam structure. The tabs then prevent a direct metal-to-metal contact between the cap and the seam structure thereby heat-insulating same.

The cap 24 for the building panel 17 is then placed in position relative to panel 17 with the edge portion 28 positioned on the overlapping tabs and the outer portion of the seam structure 22 of the next adjacent panel 18. The side edge portion 27 caps or covers seam structure 21 to which the tabs and section 31*a* have been applied. The fastening section 36 is then folded back against the underside of the inclined portion 31*c* of the adjacent cap, preferably using a suitable seam-forming device or the like. One seaming operation then fastens two cap side edges at the same time. The next adjacent cap is placed over the panel 18 and the fastening procedure is repeated as above described to complete the locking of the cap over the panel 17.

Referring now to FIG. 8, the arched, composite structure 11 shown has three arched, channel-shaped panels designated by numerals 56, 57 and 58 connected side by side at seam structures 61 and 62 in the same manner as shown in FIG. 3. These panels are curved and are of a sufficient length, preferably substantially semicircular in extent, to form the top and sides of a self-supporting free-standing structure with the ends resting on a foundation. Each arched panel has transverse corrugations in the bottom and corrugations in the sidewalls as described in U.S. Pat. No. 3,902,288. The cap 64 for these arched panels is similar in configuration to that of cap 24 above described but in addition has corrugations in the cover portion shown as having alternating peak and valley portions 65 and 66, respectively, extending first in one direction and then in the other from the plane of the sheet material. The closed space formed between the cap 64 and the bottom of the associated panel may have a block of insulation or this may be omitted as shown, according to specific building requirements.

From the foregoing it should be appreciated that the addition of the cap to the panel and the manner of connecting thereto result in a composite structure that is considerably stronger with greater load-bearing capabilities than the panel alone. This construction affords the possibilities of changing the gauge of materials of both the cap and the panel to achieve specific results. It has been found that, by the use of a 24-gauge sheet metal material for the panel and a 28-gauge material for the cap, the strength of the composite structure is approximately twice that of a panel made of a 20-gauge sheet metal material.

Although the present invention has been described with a certain degree of particularity, it is understood that the present disclosure has been made by way of example and that changes in details of structure may be made without departing from the spirit thereof.

What is claimed is:

1. A panel assembly in a building structure comprising:

(a) a first panel connected between a second panel and a third panel, said panels having a bottom, a pair of sidewalls projecting from opposite side edges of the associated bottom providing an outer opening and a pair of interlocking flanges projecting in a first direction from the ends of said sidewalls and connected along a first seam structure and a second seam structure on the opposite sides of said first panel joining the sidewalls of said first panel with the adjacent sidewalls of said second and third panels, (b) a fourth panel connected along the opposite side edges to said first and second seam structures covering the outer opening of said first panel, said fourth panel having:

(i) a body which includes a generally laterally extending intermediate portion in spaced overlying and covering relation to the bottom of said first panel providing a space closed on all sides, (ii) first and second side portions attached to, extending along and projecting from the opposite side edges of said intermediate portion, (a) said first side portion having:

(i) a first sidewall section disposed within and extending along a first sidewall of said first panel, (ii) a first inside section angularly extending laterally in from said first sidewall section and away from said intermediate portion at a selected incline with the plane of said intermediate portion oppositely spaced from said first seam structure, (iii) a first substantially straight flange section extending laterally out from said first inside section substantially parallel to said intermediate portion covering and strengthening said first seam structure and held in place by a substantially straight lateral flange section and a terminal lateral edge fastening section of an adjacent panel similar to said fourth panel covering the opening in said second panel joining one side edge of said fourth panel to said first seam structure to form a first composite seam structure of a generally hollow triangular structural shape, (c) said second side portion located substantially laterally out from the associated intermediate portion and having:

(i) a second sidewall section disposed within and extending along a second sidewall of said first panel, (ii) an arcuate section extending laterally generally in from and in horizontally spaced relationship to an associated intermediate portion providing a track for a seamforming device for fastening adjacent similar fourth panels to said first and second seam structures, (iii) a second substantially straight flange section extending laterally out from said arcuate section in spaced substantially parallel relation to an associated intermediate portion covering and strengthening said second seam structure, (iv) a terminal lateral edge fastening section projecting beyond said second flange section angularly folded back and laterally inwardly against a first inside section of a next adjacent panel similar to said fourth panel and said terminal lateral edge adapted initially to extend outwardly and toward an associated intermediate portion to form an inwardly facing channel-like configuration with a receiving opening of a sufficient lateral dimension in relation to the lateral dimension of the first lateral flange section and first inside section of said next adjacent panel similar to said fourth panel to receive them by insertion via said receiving opening, said receiving opening having been narrowed by a seam-forming device covering said receiving opening in said third panel joining the other side edge of said fourth panel to said second seam structure to form a second composite longitudinally continuous seam structure of a generally hollow triangular structural shape, (d) said interlocking flanges of said first and second panels being secured within the area formed by the first inside section and substantially straight flange section of the associated first side portion of said fourth panel and said next adjacent panel similar to said fourth panel.

2. A panel assembly as set forth in claim 1 including a layer of heat insulation between opposed surfaces of said fourth panel and said first and second seam structures.

3. A panel assembly as set forth in claim 1 including a block of heat insulation in said space closed on all sides.

4. A panel assembly as set forth in claim 3 wherein said block of heat insulation has a pair of opposed tab portions of a heat-insulation material that project from the opposite marginal side edges thereof, each tab portion having a coating of an adhesive material, said tab portions of adjacent blocks in adjacent panels being fastened to the seam structure joining the adjacent panels and overlapping at the edges to heat-insulate the fourth panel from the connected first, second and third panels.

5. A panel assembly as set forth in claim 3 wherein each of said panels is longitudinally curved and of sufficient length to form the top and sides of a self-supporting, free-standing structure with the ends thereof resting on a foundation.

* * * * *